US005640875A

United States Patent [19]

Horde et al.

[11] Patent Number: 5,640,875

[45] Date of Patent: Jun. 24, 1997

[54] DIE TRANSFER SYSTEM WITH MODULAR TRANSFER DRIVE

[75] Inventors: Boice F. Horde, Westland; Lyle T. Giles, Harper Woods, both of Mich.

[73] Assignee: Livernois Die and Automation, Dearborn, Mich.

[21] Appl. No.: 546,538

[22] Filed: Oct. 20, 1995

[51] Int. Cl.[6] ..... B21D 43/05

[52] U.S. Cl. ..... 72/405.13; 72/405.11

[58] Field of Search ..... 72/405.11–405.16, 72/405.01; 198/621.1

[56] References Cited

U.S. PATENT DOCUMENTS

| | | | |
|---|---|---|---|
| 4,032,018 | 6/1977 | Wallis . | |
| 4,272,981 | 6/1981 | Endter | 72/405.12 |
| 5,307,666 | 5/1994 | Bianchi . | |
| 5,473,927 | 12/1995 | Brandstetter | 72/405.14 |

FOREIGN PATENT DOCUMENTS

| | | | |
|---|---|---|---|
| 4320057 | 9/1994 | Germany | 72/405.13 |

OTHER PUBLICATIONS

Wallis, "Transfer Die Technology," Livernois Automation Company (1991).

"Rotary Cam Series Transfer Systems," Livernois Automation Company, Brochure LAC–2003 (Feb. 1990).

*Primary Examiner*—Daniel C. Crane

*Attorney, Agent, or Firm*—Barnes, Kisselle, Raisch, Choate, Whittemore & Hulbert, P.C.

[57] ABSTRACT

A die transfer system for transferring workpieces between successive die stations in a stamping press includes elongated finger bars having spaced fingers for engaging workpieces at successive die stations, a first drive module for reciprocating the finger bar laterally into and out of engagement with the workpieces at the die stations, and a second or transfer drive module for reciprocating the finger bar longitudinally for transferring workpieces between the successive die stations. The transfer drive module includes a pair of laterally spaced transfer drive mechanisms respectively positioned adjacent to the ends of the finger bars, and a bridge that extends between the transfer drive mechanisms. A pair of carriages are mounted on the bridge and coupled by lead screws to respective stepper motors for adjusting position of each carriage laterally of the bridge independently of each other. Each carriage is coupled to an associated finger bar by a quick-disconnect coupling arrangement. In this way, the transfer drive mechanism may be readily disconnected from the lateral drive mechanisms for replacement of the latter, and may be readily readjusted for and connected to new lateral drive mechanisms of differing configuration.

26 Claims, 7 Drawing Sheets

DIE TRANSFER SYSTEM WITH MODULAR TRANSFER DRIVE

The present invention is directed to die transfer systems, and more particularly to a modular arrangement for indexing workpieces through successive die stations in a stamping press.

BACKGROUND AND SUMMARY OF THE INVENTION

In die transfer systems of the subject character, a finger bar extends along one or both lateral sides of the die stations of a stamping press, and fingers extend inwardly from the finger bar or bars for engaging workpieces at the successive die stations. The finger bar or bars are driven longitudinally and laterally in synchronism with operation of the press for transferring workpieces through successive die stations and then out of the die. U.S. Pat. Nos. 4,032,018 and 5,307,666 each disclose die transfer systems of this general character, in which the finger bars are mechanically coupled by cam-and-follower arrangements to the ram of the stamping press for controlling operation of the finger bars. U.S. application Ser. No. 08/280,089, now U.S. Pat. No. 5,557,959, assigned to the assignee hereof, discloses an improved die transfer system in which the mechanisms for driving the finger bar(s) in lateral and longitudinal directions are provided as separate system modules.

In die transfer systems of the subject character heretofore proposed, replacement of the lateral finger bar drive mechanisms or modules to accommodate different workpieces or different dies, for example, normally requires either replacement or extensive rework of the longitudinal or transfer drive mechanism as well. That is, in typical conventional transfer system constructions, the transfer drive is specifically constructed for use in conjunction with a specific lateral drive construction, so that change-over of the die to manufacture a different part requires complete transfer system replacement. It is a general object of the present invention to provide a transfer module for a die transfer system that is readily adapted for use in conjunction with a variety of lateral drive modules, and may be readily configured for use in conjunction with differing lateral drive modules electronically and without requiring replacement of parts or components. Another and more specific object of the present invention is to provide a transfer module of the described character, and a drive transfer system embodying such transfer module, that may be readily programmed for use in conjunction with lateral drive modules of differing size, and longitudinal strokes of differing pitch.

A die transfer system for transferring workpieces between successive die stations in a stamping press includes an elongated finger bar having spaced fingers for engaging workpieces at successive die stations, a first drive module for reciprocating the finger bar laterally into and out of engagement with the workpieces at the die stations, and a second or transfer drive module for reciprocating the finger bar longitudinally for transferring workpieces between the successive die stations. In accordance with the presently preferred embodiment of the invention, the transfer drive module includes a transfer drive mechanism for placement adjacent to one longitudinal end of the finger bar, and a transfer coupling for releasably connecting the transfer drive mechanism to the finger bar for reciprocating the finger bar in the longitudinal direction between the successive drive stations. The transfer coupling is adjustably positionable laterally of the transfer drive mechanism for alignment with the finger bar, such that the transfer drive module is usable in conjunction with differing lateral drive mechanisms having different lateral positioning and motions of the finger bar.

In the preferred embodiment of the invention having finger bars that extend along opposed lateral sides of the die stations, a pair of laterally spaced transfer drive mechanisms are respectively positioned adjacent to the ends of the finger bars, and a bridge extends between the transfer drive mechanisms. A pair of carriages are mounted on the bridge and coupled by lead screws to respective stepper motors for adjusting position of each carriage laterally of the bridge independently of each other. Each carriage is coupled to an associated finger bar by a quick-disconnect coupling arrangement. In this way, the transfer drive mechanism may be readily disconnected from the lateral drive mechanisms for replacement of the latter, and may be readily readjusted for and connected to new lateral drive mechanisms of differing configuration.

The carriages in the preferred embodiment of the invention are coupled to respective associated sensors for providing a signal indicative of lateral position of each carriage. A controller receives signals indicative of desired position of each carriage, and controls motion of each carriage drive motor as a combined function of such desired position signal and position feedback signals from the carriage sensors. The quick-disconnect coupling for connecting the carriage(s) to the finger bar(s) in the preferred embodiment of the invention comprise a ball-and-socket connection arrangement that includes a ball mounted on each finger bar, an arm that extends from each carriage, and a socket at the end of each arm for releasably fastening the arm to an associated ball. A toggle clamp on each arm adjacent to the associated carriage is connected to a shaft that extends through the arm to a position adjacent to the socket for releasably capturing the ball. Each arm in the preferred embodiment of the invention is coupled to the associated carriage to pivot about a vertical axis as the finger bar moves laterally into and out of engagement with workpieces at the work stations, and about a horizontal axis as the finger bar moves vertically to raise workpieces from and place workpieces on the die stations.

The transfer drive mechanisms in the preferred embodiment of the transfer system comprise endless belt drive mechanisms. A single electric motor powers both transfer drive mechanisms by means of a shaft that extends laterally between the drive mechanisms. The shaft is a split shaft, having an inter-connection coupling for adjusting phase of the transfer drive mechanisms with respect to each other. Flags on one of the transfer drive mechanisms cooperate with proximity sensors for indicating limits of travel of the transfer drive mechanisms, and for indicating a home position of the transfer drive mechanisms. The electronic controller includes facility for programming offset from such home position to a start position for the transfer mechanisms as a function of the application in which the transfer system is employed.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
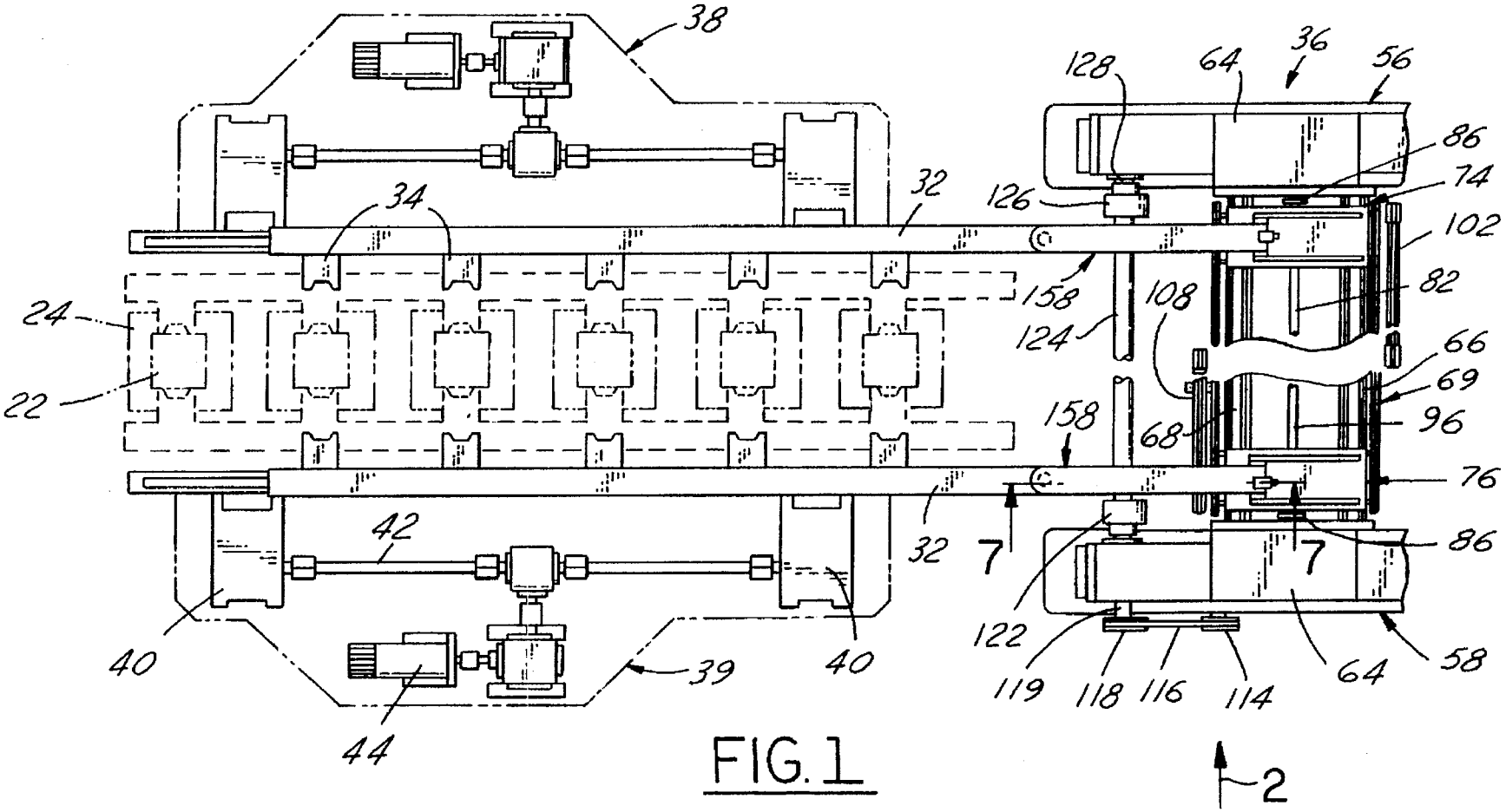
FIG. 1 is a plan view of a die transfer system in accordance with one presently preferred embodiment of the invention.

FIG. 1 illustrates a die transfer system 20 in accordance with one presently preferred embodiment of the invention for transferring workpieces 22 between successive die stations 24 on the lower die of a stamping press having an upper die coupled to a press ram. Transfer system 20 includes a pair of elongated parallel finger bars 32 each having a plurality of longitudinally spaced fingers 34 for engaging workpieces 22 at successive die stations 24. (It will be appreciated, of course, that directional adjectives such as "longitudinal" and "lateral" are taken with reference to the direction of motion of workpieces 22 between and through successive die stations 24.) A longitudinal or transfer drive module 36 is positioned at one end of transfer system 20, and is coupled to finger bars 32 for reciprocating the finger bars back and forth in the direction of their length, thereby transferring workpieces through the successive die stations. A pair of laterally opposed drive modules 38,39 are coupled to finger bars 32 for reciprocating the finger bars laterally into and out of engagement with the workpieces at the die stations.

Lateral drive modules 38,39 are mirror images of each other. Each lateral drive module 38,39 has two finger bar modules 40 coupled to the associated finger bar 32 and spaced from each other lengthwise of the finger bar. A drive shaft 42 extends between and interconnects drive modules 40. Drive shaft 42 is rotated in synchronism with operation of the stamping press by an electric servo motor 44 and an associated motor controller (FIG. 9) coupled to a sensor 182 for monitoring position of the stamping press. To the extent thus far described, transfer system 20 is essentially the same as that disclosed in above-noted U.S. application Ser. No. 08/280,089, the disclosure of which is incorporated herein by reference for purposes of detailed disclosure of structure and operation of lateral drive modules 38,39.

Figure 2:
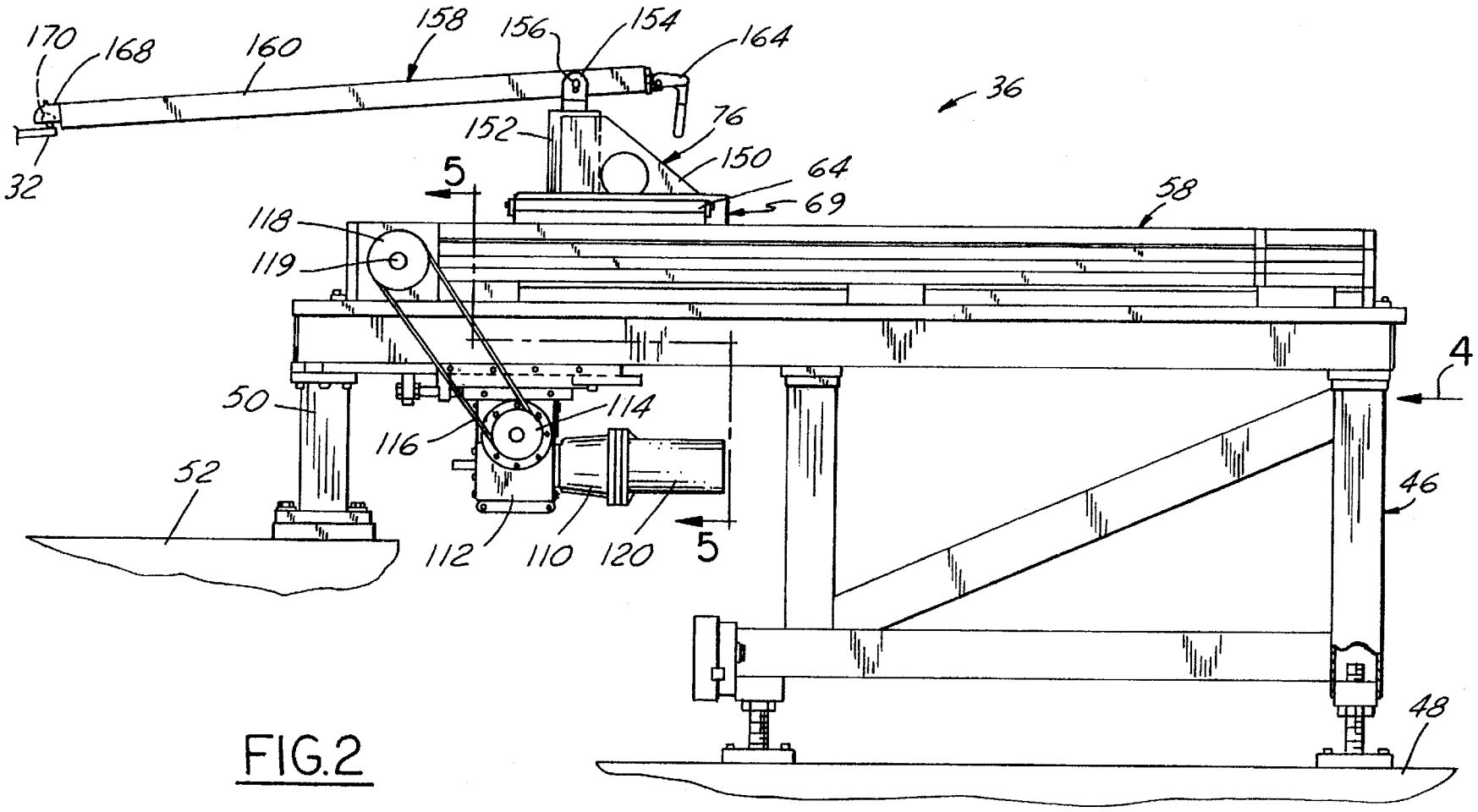
FIG. 2 is a side elevational view of the transfer module in the die transfer system illustrated in FIG. 1, being taken from the direction 2 in FIG. 1.
Figure 3:
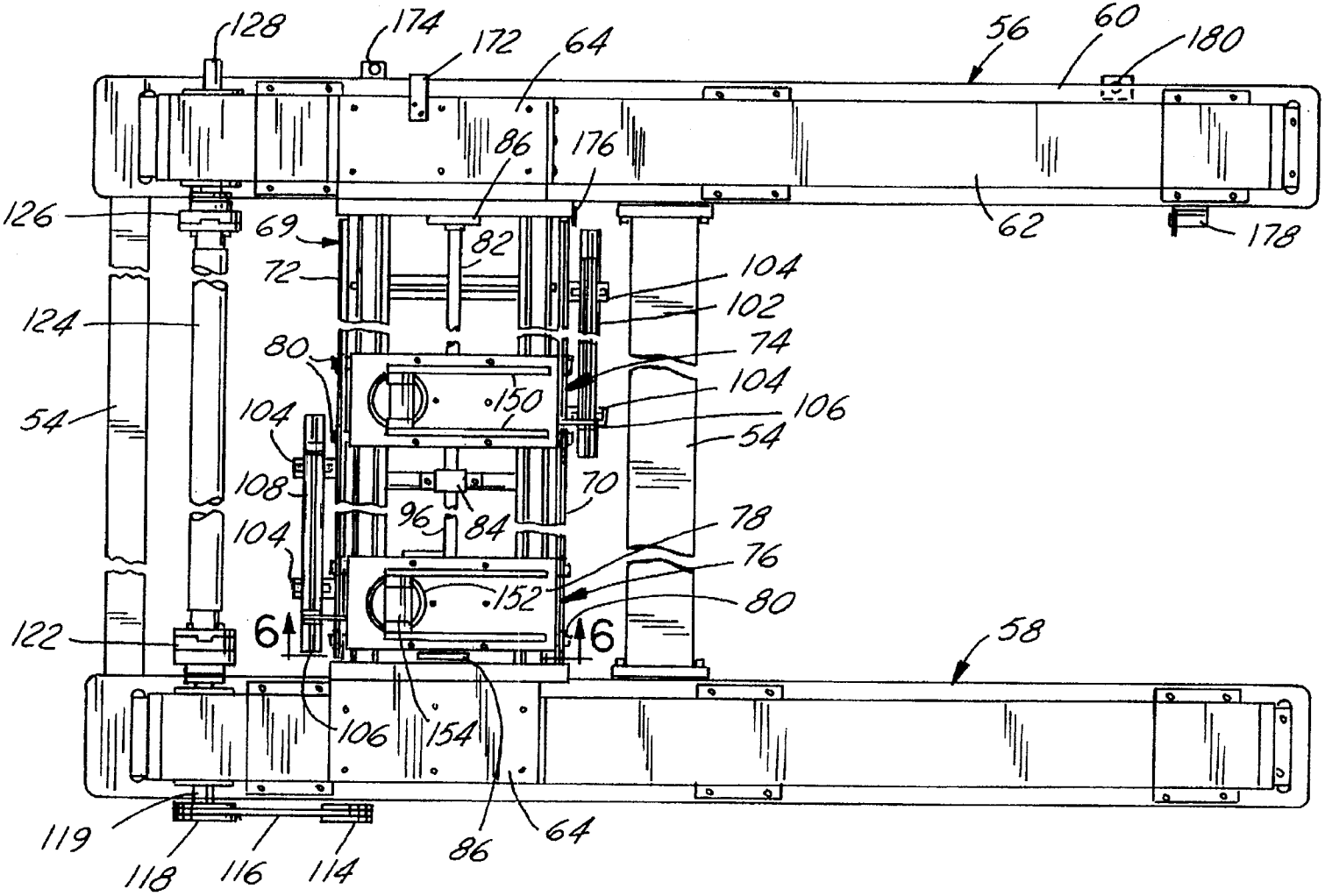
FIG. 3 is a plan view of the transfer module illustrated in FIG. 2.
Figure 4:
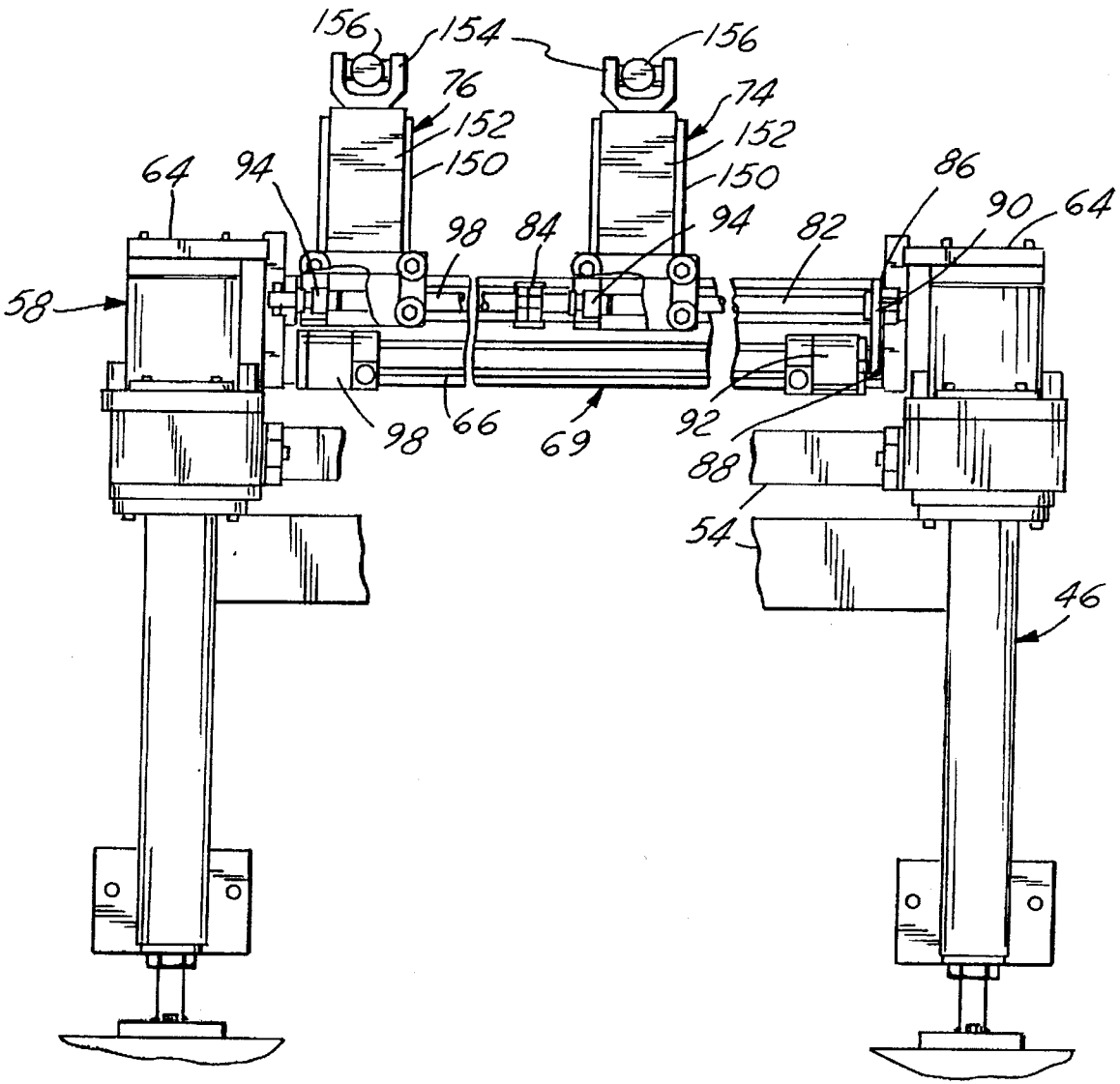
FIG. 4 is a fragmentary end elevational view taken substantially from the direction 4 in FIG. 2.

Transfer module 36 is illustrated in detail in FIGS. 2–8. A generally rectangular support frame 46 has feet coupled to a baseplate 48, which in turn rests upon the plant floor. The forward edge of frame 46 has laterally spaced legs 50 (FIGS. 1 and 5) for resting on the bed 52 (FIG. 1) of the stamping press. Cross members 54 rigidify frame 46. A pair of elongated belt drive units 56,58 are mounted in fixed position at the laterally spaced side edges of frame 46, and extend parallel to each other in the longitudinal direction of transfer system 20. Each belt drive unit 56,58 includes an associated generally rectangular housing 60 and an endless drive belt 62 that is trained around spaced pulleys (not shown) within housing 60. Belts 62 are exposed along the upper surface of each housing 60 for external drive connection. An L-shaped carriage 64 is fastened to each drive belt 62 of each drive unit 56,58, and extends laterally inwardly and then downwardly therefrom as best seen in FIG. 4. A pair of elongated extrusions 66,68 are fastened to and extend between L-shaped carriages 64 so as to form a bridge 69 extending between and rigidly interconnecting the carriages. Bridge 69 formed by extrusions 66,68 thus moves in the longitudinal direction conjointly with carriages 64 under power of belt drive units 56,58.

Figure 6:
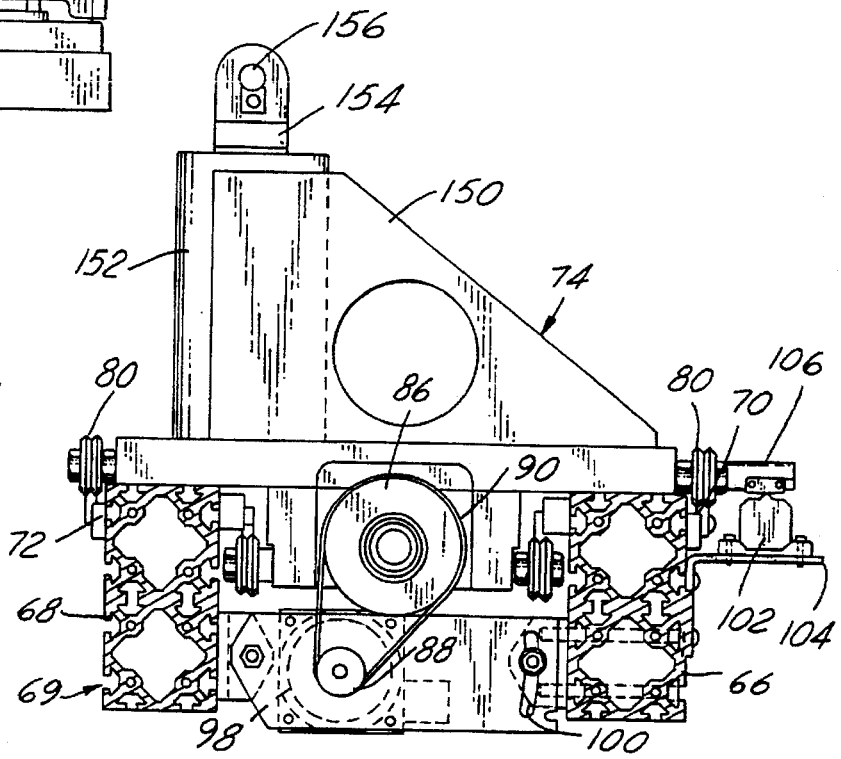
FIG. 6 is a sectional view taken substantially along the line 6—6 in FIG. 3.
Figure 7:
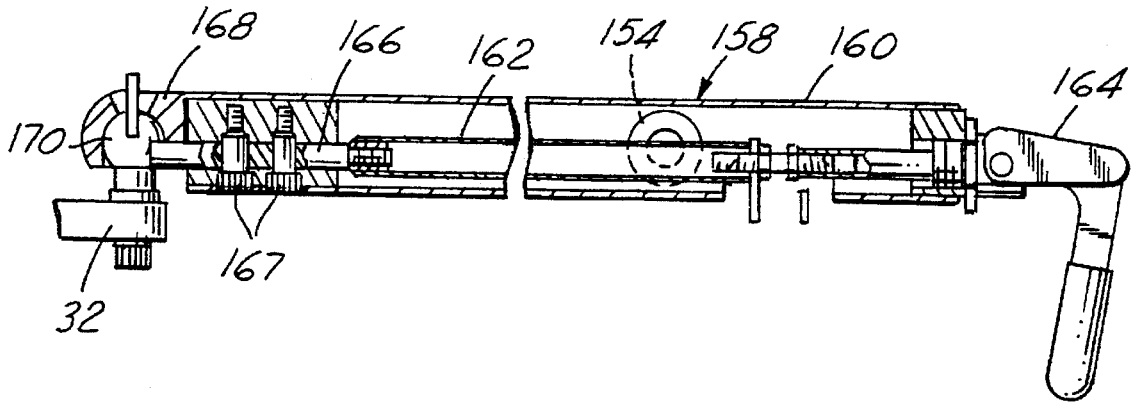
FIG. 7 is a fragmentary sectional view taken substantially along the line 7—7 in FIG. 1.

A pair of parallel bearing rails 70,72 are mounted on and extend along the outside upper edges of extrusions 66,68, as best seen in FIGS. 3 and 6. A pair of bridge carriages 74,76 each have a rectangular base 78 supported by a plurality of rollers 80 disposed at each corner of base 78 for motion along spaced bearing rails 70,72. A lead screw 82 extends from a bearing 84, which is centrally supported on bridge 69 between extrusions 66,68, beneath carriage 74 to an opposing axially aligned bearing on carriage 64 of belt drive unit 56. Lead screw 82 is coupled by a pair of pulleys 86,88 and a drive belt 90 to a stepper motor 92 mounted between extrusions 66,68 adjacent to carriage 64 of unit 56. Lead screw 82 is coupled to track carriage 74 by means of a lead screw nut 94 (FIG. 4) mounted beneath base 78 of carriage 74. In the same way, a lead screw 96 extends from bearing 78 to an aligned bearing on carriage 64 of drive unit 58, and is connected by a belt 90 and associated pulleys 86,88 (FIG. 6) to a stepper motor 98 mounted between extrusions 66,68 adjacent to carriage 64 of drive unit 58. Lead screw 98 is coupled to track carriage 76 by means of a nut 94 mounted beneath base 78 of carriage 76. Both stepper motors 92,98 are mounted on brackets having slotted openings 100 (FIG. 6) for adjusting tension of belts 90. Thus, track carriages 74,76 are supported by rollers 80 between rails 70,72 for motion laterally of transfer system 20 independently of each other under control of respective stepper motors 92,98. Each carriage 74,76 may traverse one half of the total length of bridge 69 formed by extrusions 66,68, bearing 84 being disposed centrally of the bridge. Lead screws 82,96 are axially aligned.

A position transducer 102 (FIGS. 1,3,6 and 9) is mounted by a pair of brackets 104 on extrusion 66 adjacent and parallel to rail 70, and extends along the edge of extrusion 66 for a distance corresponding to the distance of travel for carriage 74 on bridge 69. An arm 106 (FIGS. 3 and 6) extends from carriage 74 for operatively coupling the carriage to position transducer 102. Likewise, a second position transducer 108 is mounted by brackets 104 to extrusion 68 adjacent and parallel to rail 72, and extends along the extrusion for a distance corresponding to distance of travel of carriage 76 on bridge 69. Carriage 76 is coupled to transducer 108 by arm 106. Transducers 102,108 may be of any suitable type for providing electrical output signals that vary as a function of position of the associated carriage 74,76 along the track formed by bridge extrusions 66,68. In a working embodiment of the invention, transducers 102, 108 comprise Temposonics linear displacement transducer model number LPMLSU48.0.

Figure 5:
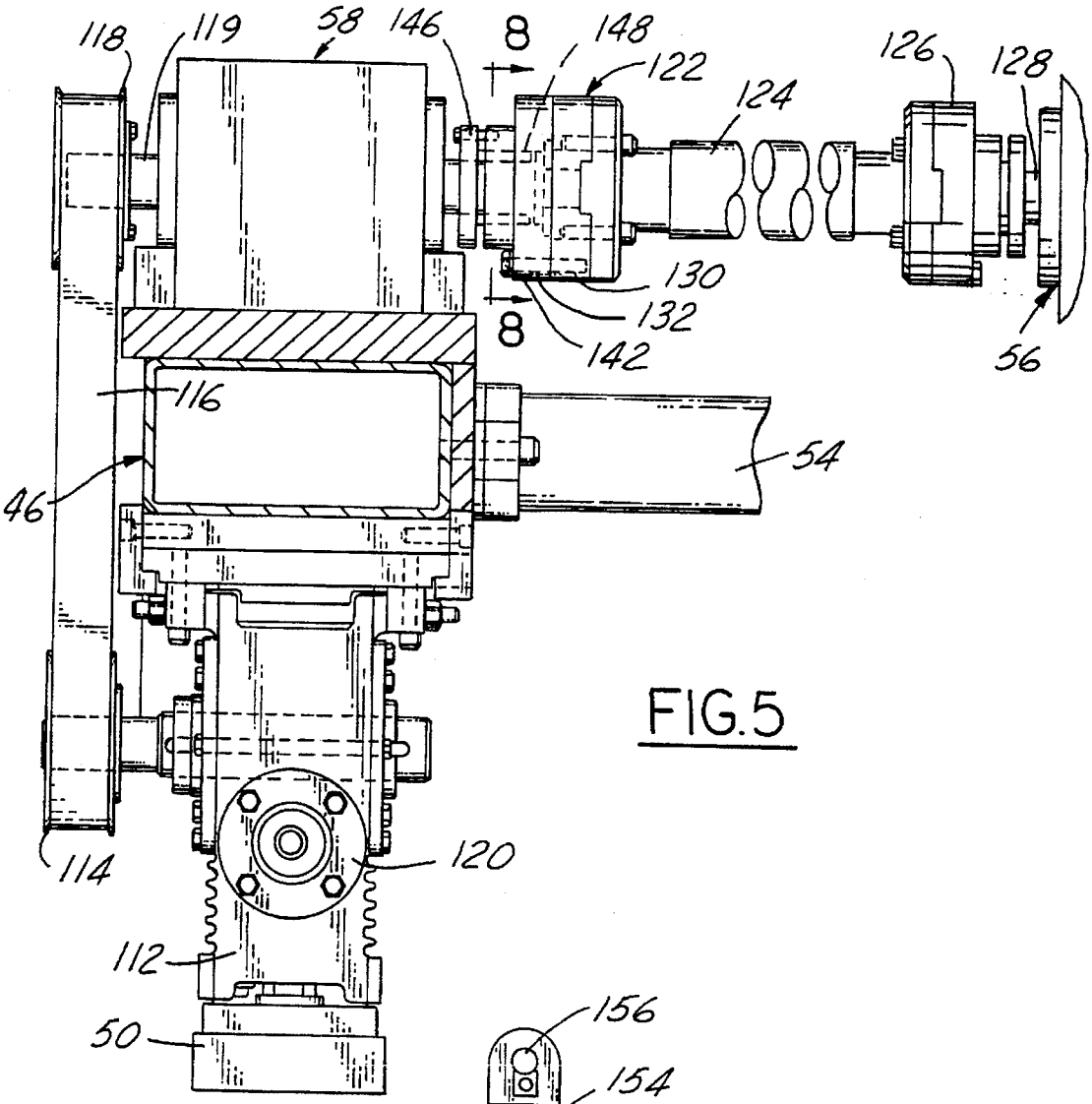
FIG. 5 is a fragmentary section view taken substantially along the line 5—5 in FIG. 2.
Figure 8:
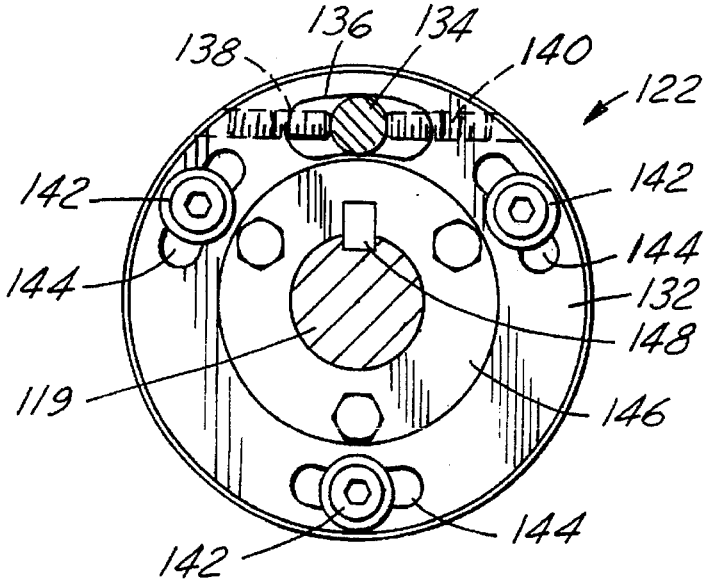
FIG. 8 is a sectional view taken substantially along the line 8—8 in FIG. 5.

A transfer motor 110 (FIGS. 2 and 9) is suspended in fixed position beneath belt drive unit 58 on frame 46. Motor 110 is connected to a gearbox 112 (FIGS. 2 and 5), and thence by a pulley 114, a belt 116 and a pulley 118 to the drive input 119 of belt drive unit 58. A resolver 120 or other suitable position transducer is mounted on transfer drive motor 110 for providing an electrical output signal as a function of transfer position. Input drive shaft 119 (FIG. 5) of belt drive unit 58 extends through the belt drive unit to a phase-adjustment coupler 122. The output of coupler 122 is fed by a drive shaft 124 and a coupler 126 to the input shaft 128 of belt drive unit 56. Thus, transfer motor 110 powers both belt drive units 56,58. Coupler 122 provides for phase adjustment between the belt drive units. Referring in particular to FIGS. 5 and 8, coupler 122 comprises a pair of axially opposed hubs 130,132, which are both keyed and connected to shaft 120 and shaft 124 respectively. A pin 134 is fastened to hub 130, and extends through an arcuate slotted opening 136 in hub 132 in a direction parallel to but radially offset from the aligned axes of shafts 120,124. A pair of set screws 138,140 are received in respective internally threaded openings in hub 132 that are aligned with each other and extend tangentially into engagement with pin 134 within opening 136. Thus, by manipulation of set screws 134,140, the angular relationship between hubs 130,132, and thus the phase relationship between shafts 120,124, may be adjusted. A plurality of screws 142 extend through corresponding arcuate openings 144 in hub 132 into threaded openings in hub 130 for tightly clamping the hubs to each other at the desired adjusted phase relationship between the hubs. Hubs 130,132 are fastened to respective shaft sections 120,124 by associated taper lock bushings 146 and keys 148.

Each carriage 74,76 has a pair of laterally spaced side plates 150 (FIGS. 2–4) that support a vertically oriented cylinder 152. A buckle 154 is mounted on each cylinder 152 for rotation about the vertical axis of the cylinder. A pin 156 extends horizontally through each buckle 154. A quick-disconnect arm assembly 158 is pivotally mounted on each pin 156 for rotation about the horizontal axis of the pin. Each quick-disconnect arm assembly 158 comprises a hollow arm body 160 having a shaft 162 (FIG. 7) extending longitudinally therethrough. Shaft 162 is connected at one end to a toggle clamp handle 164, and at the opposing end to a lock pin 166. Lock pin 166 has flat sides guided by shoulder bolts 167. Arm body 160 terminates at the end thereof remote from toggle clamp handle 164 in a downwardly opening socket 168, which is adapted to be received over a ball 170 mounted on the end of finger bar 32. Thus, each arm 158 forms a trailer-hitch type quick-disconnect coupling to the end of an associated finger bar 32. When toggle clamp handles 164 are in the position illustrated in FIGS. 2 and 7, pins 166 extend into socket 168 so as to engage ball 170 within socket 168, and thereby firmly to clamp arm 158 to finger bar 32. When toggle clamp handles 164 are pivoted counterclockwise from the position illustrated in FIGS. 2 and 7, pins 166 are extracted from socket 168, so that socket 168 and arm 158 may be moved upwardly away from ball 170 and finger bar 32. Since each arm 158 is mounted to its associated carriage 74,76 for pivotal motion about both a horizontal axis defined by pin 156 and buckle 154, and a vertical axis defined by buckle 154 and cylinder 152 (FIG. 2). The arms may thus follow horizontal and vertical motion of finger bars 32 without moving carriages 74,76. (Arms 158 are not shown in FIGS. 3 and 6 for purposes of clarity.)

A flag 172 (FIG. 3) extends laterally outwardly from carriage 64 on belt drive unit 56, and cooperates with a proximity sensor 174 in fixed position on belt drive unit 56 for indicating when the belt drive units and transfer bridge 69 have reached a forward limit of travel in the longitudinal direction. In the same way, a flag 176 (FIG. 3) on carriage 64 cooperates with a second proximity sensor 178 in fixed position on the opposing end of belt drive unit 56 for indicating when the belt drive units and transfer bridge have reached the opposing limit of travel in the longitudinal direction. Flag 172 also cooperates with a third proximity sensor 180 on belt drive unit 56 for indicating a home position of transfer bridge 69 retracted from the press bed.

Figure 9:
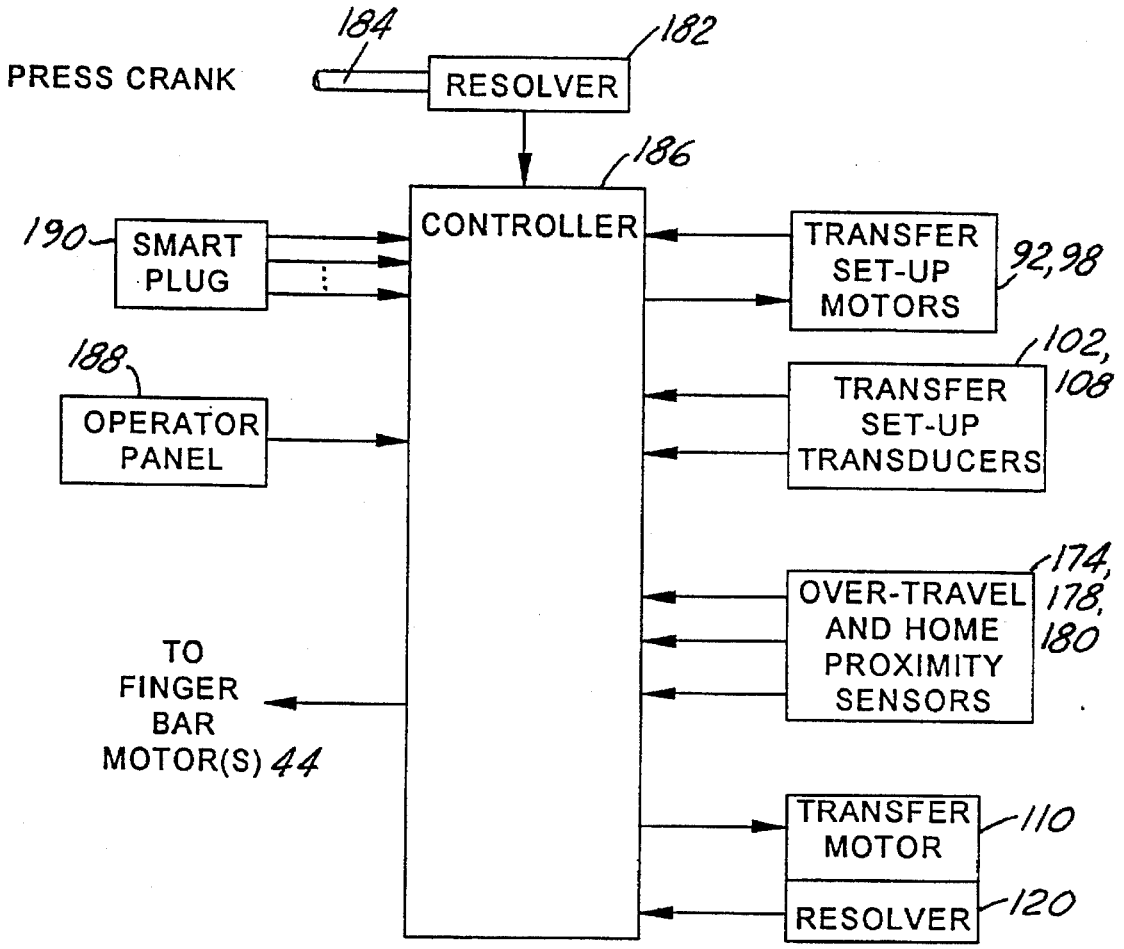
FIG. 9 is a functional block diagram of the transfer drive control electronics.

The transfer drive electronics are illustrated functionally in FIG. 9. A resolver or other suitable position sensor 182 is coupled by a shaft 184 to the crank of the stamping press, and provides an electrical output signal indicative of press position to the transfer motor control electronics package. A controller 186 receives the electrical signal from sensor 182 indicative of press position. Controller 186 also receives input signals from transfer set-up linear transducers 102,108, over-travel and home-position proximity sensors 174,178 and 180, and transfer drive motor resolver 120. Controller 186 provides output control signals to transfer drive motor 110 and transfer set-up stepper motors 92,98. Controller 186 also controls operation of finger bar lateral drive motors 44 (FIG. 1). Controller 186, which is functionally illustrated as a unitary element in FIG. 9, may comprise several separate controllers configured in master and slave relationship, as illustrated in above-referenced Ser. No. 08/280,089, now U.S. Pat. No. 5,559,959. Controller 186 also receives control inputs from an operator panel 188 and a smart plug 190 for inputting parameters for set-up and operation of the transfer system. Smart plug 190 may be a plug of any suitable configuration in which internal wiring programs set-up parameters of controller 186. For example, a plug 190 having eight pins that may be selectively connected to a voltage or ground potential can be employed for setting two hundred fifty-six parameter combinations prestored in controller 186. Such set-up parameters may be modified or alternatively set by operator panel 188.

Upon initiating operation of the transfer system, transfer bridge 69 is first retracted by controller 186 and motor 110 to the home position at which flag 172 is adjacent to proximity sensor 180. The transfer bridge is then moved to a start position from this home position by an offset amount determined by parameter input from operator panel 188 or smart plug 190. This motion of the transfer bridge is monitored by monitoring the output of transfer drive motor resolver 120. At the same time, controller 186 inputs the desired lateral set-up position of the transfer carriages, either from operator panel 188 or from internal memory per smart plug 190. Controller 186 then controls operation of each transfer carriage set-up motor 92,98, independently of each other, while monitoring outputs from the associated carriage set-up transducers 102,108. When the carriages are in the desired positions aligned with the respective finger bars, the carriages may be connected to the finger bars by means of transfer arms 158 as previously discussed. The die transfer system may then proceed to normal operation, in which lateral finger bar drive motors 44 and transfer system drive motor 110 are operated by controller 186 for moving workpieces through the die system. Flags 172,176 and proximity sensors 174,178 function to prevent over-travel of the transfer drive carriage during both normal operation and set-up.

We claim:

1. For use in a die transfer system for transferring workpieces between successive die stations in a stamping press, and including elongated bar means having spaced means for engaging workpieces at successive die stations and means for reciprocating said bar means laterally into and out of engagement with workpieces at the die stations, a transfer module that comprises:

transfer drive means for placement adjacent to one longitudinal end of said bar means, transfer coupling means for releasably coupling said transfer drive means to said bar means for reciprocating said bar means longitudinally to transfer the workpieces between successive die stations, and means for adjustably positioning said transfer coupling means laterally of said transfer drive means for alignment with said bar means, such that said transfer module is usable in conjunction with differing bar means and laterally reciprocating means having differing lateral positioning and motion of said bar means, said transfer coupling means comprising means coupled to and extending laterally from said transfer drive means forming a track that reciprocates longitudinally with said transfer drive means, and means laterally adjustably positionable on said track for coupling said track and said transfer drive means to said bar means.

2. The transfer module set forth in claim 1 wherein said means laterally adjustably positionable on said track comprises a carriage and means for moving said carriage along said track.

3. The transfer module set forth in claim 2 wherein said means for moving said carriage comprises an electric motor, means coupling said motor to said carriage, and control means coupled to said motor for controlling operation of said motor variably to position said carriage along said track.

4. The transfer module set forth in claim 3 wherein said means for moving said carriage comprises position programming means for setting a desired position of said carriage on said track, said control means being responsive to said position programming means to move said carriage to said desired position on said track.

5. The transfer module set forth in claim 4 wherein said control means further comprises means coupled to said carriage for providing an electrical signal indicative of position of said carriage on said track, and means for controlling motion of said carriage on said track as a combined function of said desired position and said electrical signal.

6. The transfer module set forth in claim 3 wherein said means coupling said electric motor to said carriage comprises a lead screw.

7. The transfer module set forth in claim 2 wherein said transfer coupling means further comprises an arm extending from said carriage and quick-disconnect coupling means at an end of said arm for releasably coupling said arm to said bar means.

8. The transfer module set forth in claim 7 wherein said quick-disconnect coupling means comprises a ball-and-socket connector including means for mounting a connector ball on said bar means, means forming a socket at said end of said arm and means for releasably fastening said socket over said ball.

9. The transfer module set forth in claim 8 wherein said releasably fastening means comprises a toggle clamp on said arm adjacent to said carriage and a toggle bar coupled to said toggle clamp and extending along said arm to a position adjacent to said socket.

10. The transfer module set forth in claim 1 wherein said transfer drive means comprises first means for disposition in stationary position, second means supported by said first means for movement in a longitudinal direction along said first means, an electric transfer drive motor coupled to said second means, and transfer control means for controlling motion of said transfer drive motor to reciprocate said second means with respect to said first means.

11. The transfer module set forth in claim 10 wherein said transfer control means further comprises means coupled to said transfer drive motor for providing an electrical signal to said transfer control means indicative of position of said second means with respect to said first means.

12. The transfer module set forth in claim 11 wherein said transfer drive means further comprises position programming means for setting a desired start position of said second means with respect to said first means, said transfer control means being responsive to said position programming means and to said electrical signal for controlling operation of said electric motor.

13. The transfer module set forth in claim 12 further comprising means on said first means for defining a home position of said second means with respect to said first means, said transfer control means being responsive to said position programming means and to said electrical signal for controlling operation of said electric motor with respect to said home position.

14. The transfer module set forth in claim 13 further comprising means on said first means for defining limits of travel of said second means with respect to said first means, said transfer control means being responsive to said limits-defining means to control operation of said motor.

15. The transfer module set forth in claim 1 for use in a die transfer system having a pair of said bar means disposed on laterally opposed sides of the die stations, wherein said transfer drive means comprises a pair of laterally spaced transfer drive means adjacent to longitudinal ends of said bar means, wherein said transfer coupling means comprises a bridge extending between said transfer drive means forming a track that reciprocates longitudinally with said transfer drive means and a pair of carriages laterally adjustably positionable on said track, and wherein said adjustably positioning means comprises means for moving said carriages along said track independently of each other.

16. In a die transfer system for transferring workpieces between successive die stations in a stamping press, and including elongated bar means disposed on opposed lateral sides of the die stations and having spaced means for engaging workpieces at the successive die stations, first means for reciprocating said bar means laterally into and out of engagement with workpieces at the die stations, and second means for reciprocating said bar means longitudinally for transferring the workpieces between the successive die stations, the improvement wherein said second means comprises:

laterally spaced first and second transfer drive means disposed adjacent to respective ends of said bar means, means extending laterally between said first and second transfer drive means and coupled to said first and second transfer drive means to reciprocate longitudinally conjointly with said transfer drive means, a pair of carriages carried by said laterally extending means for lateral motion thereon, means for moving said carriages laterally along said laterally extending means independently of each other, and means for releasably coupling each said carriage to a corresponding one of said bar means.

17. The system set forth in claim 16 wherein said carriage-moving means comprises a pair of electric motors, and means coupling each said motor to an associated carriage independent of the other motor and carriage.

18. The system set forth in claim 17 wherein said carriage-moving means further comprises position programming means for setting a desired position for each said carriage, and control means responsive to said position programming means for controlling operation of each said motor.

19. The system set forth in claim 16 wherein said releasably coupling means comprises an arm extending from said carriage and quick-disconnect coupling means at an end of said arm for releasably coupling said arm to one of said bar means.

20. The system set forth in claim 16 wherein said second means further comprises a single transfer drive motor coupled to said first transfer drive means, a drive shaft extending from said first transfer drive means to said second transfer drive means, and means coupled to said shaft for adjusting phase of said second transfer drive means with respect to said first transfer drive means.

21. The system set forth in claim 20 wherein said drive shaft comprises a pair of aligned shaft segments, and wherein said phase-adjusting means comprises a pair of hubs on adjacent ends of said shaft segments, a pin on one of said hubs extending through an opening in the other of said hubs in a direction parallel to said shaft, and a pair of set screws on said other of said hubs tangential to said opening for adjusting position of said pin in said opening angularly of said shaft and thereby adjusting phase of said shaft segments with respect to each other.

22. For use in a die transfer system for transferring workpieces between successive die stations in a stamping press, and including a pair of elongated bar means disposed on laterally opposed sides of the die stations and having spaced means for engaging workpieces at successive die stations, and means for reciprocating said bar means laterally into and out of engagement with workpieces at the die stations, a transfer module that comprises:

a pair of laterally spaced transfer drive means for placement adjacent to longitudinal ends of said bar means, transfer coupling means for releasably coupling said pair of transfer drive means to said pair of bar means for reciprocating said pair of bar means longitudinally to transfer the workpieces between successive die stations, including a bridge extending between said pair of transfer drive means forming a track that reciprocates longitudinally with said transfer drive means and a pair of carriages laterally adjustably positionable on said track, and means for adjustably positioning said transfer coupling means laterally of said transfer drive means for alignment with said bar means, such that said transfer module is usable in conjunction with differing bar means and laterally reciprocating means having differing lateral positioning and motion of said bar means, including means for moving said carriages along said track independently of each other.

23. The transfer module set forth in claim 22 wherein said pair of laterally spaced transfer drive means comprises a single transfer drive motor coupled to one of said transfer drive means, a drive shaft extending from said one transfer drive means to the other transfer drive means, and means coupled to said shaft for adjusting phase of said other transfer drive means with respect to said one transfer drive means.

24. The transfer module set forth in claim 23 wherein said drive shaft comprises a pair of aligned shaft segments, and wherein said phase-adjusting means comprises a pair of hubs on adjacent ends of said shaft segments, a pin on one of said hubs extending through an opening in the other of said hubs in a direction parallel to said shaft, and a pair of set screws on said other of said hubs tangential to said opening for adjusting position of said pin in said opening angularly of said shaft and thereby adjusting phase of said shaft segments with respect to each other.

25. The transfer module set forth in claim 24 wherein said opening in said other of said hubs is elongated angularly of said shaft.

26. The transfer module set forth in claim 25 wherein said phase-adjusting means further comprises means for locking said hubs to each other.

* * * * *